US008556033B2

(12) United States Patent
Lin

(10) Patent No.: US 8,556,033 B2
(45) Date of Patent: Oct. 15, 2013

(54) SWIMMING POOL LADDER WITH A BARRIER

(75) Inventor: Hua Hsiang Lin, Xiamen (CN)

(73) Assignee: Intex Recreation Group, Long Beach, CA (US)

( * ) Notice: Subject to any disclaimer, the term of this patent is extended or adjusted under 35 U.S.C. 154(b) by 78 days.

(21) Appl. No.: 12/853,668

(22) Filed: Aug. 10, 2010

(65) Prior Publication Data

US 2011/0073410 A1 Mar. 31, 2011

(30) Foreign Application Priority Data

Aug. 11, 2009 (CN) ..... 2009 2 0182573 U

(51) Int. Cl.
*E06C 7/00* (2006.01)

(52) U.S. Cl.
USPC ..... 182/118; 182/106

(58) Field of Classification Search
USPC ..... 182/118, 106, 129, 230; 403/145, 146, 403/150, 151, 157; 248/210, 211, 220.21, 248/220.22, 230.1, 238; D25/64
See application file for complete search history.

(56) References Cited

U.S. PATENT DOCUMENTS 4,418,792 A * 12/1983 Cerone ..... 182/93
5,065,840 A * 11/1991 Cadigan ..... 182/93
5,992,563 A * 11/1999 Kessler et al. ..... 182/106
D449,895 S * 10/2001 Wilson ..... D25/63
2003/0132059 A1* 7/2003 Saputo et al. ..... 182/118
2009/0308003 A1* 12/2009 Juneau et al. ..... 52/184
2010/0044153 A1* 2/2010 Lipniarski ..... 182/113
2010/0170749 A1* 7/2010 Leung ..... 182/129
2012/0079651 A1* 4/2012 Lafontaine ..... 4/504

FOREIGN PATENT DOCUMENTS

GB 2466873 A * 7/2010

OTHER PUBLICATIONS

Confer Plastics Inc., "The Leader in Ladders Brochure", Dec. 2008, p. 2.*

* cited by examiner

*Primary Examiner* — Darnell Jayne
*Assistant Examiner* — Kristine Florio
(74) *Attorney, Agent, or Firm* — Faegre Baker Daniels LLP

(57) ABSTRACT

The present disclosure provides a swimming pool ladder with a barrier. The ladder includes two ladder sections. A top platform for supporting is connected between the upper portions of the two ladder sections and disposed above the swimming pool. The two ladder sections are respectively positioned inside and outside the swimming pool. The ladder section includes two parallel-disposed rails and a plurality of steps. The plurality of steps are mounted at intervals along the two rails from top to bottom. A barrier is provided that is perpendicular to the inner side face of the first ladder section. The barrier has a triangle shape, one edge of which is adjacent the inner side face of the first ladder section and fixed on at least two steps through at least two connectors and another edge is adjacent the inner sidewall of the swimming pool. The top end of the barrier is spaced from the top platform by a distance and the bottom end is adjacent the floor of the swimming pool.

10 Claims, 7 Drawing Sheets

SWIMMING POOL LADDER WITH A BARRIER

CROSS-REFERENCE TO RELATED APPLICATIONS

This application claims priority to Chinese Patent Application No. 200920182573.5, filed on Aug. 11, 2009. The entire disclosure of this Chinese Patent Application; Chinese Patent Application No. 200920182579.2, filed on Aug. 11, 2009; Chinese Patent Application No. 200920182572.0, filed on Aug. 11, 2009; and Chinese Patent Application No. 200920182578.8, filed on Aug. 11, 2009, are hereby incorporated by reference.

Appendices A, B, and C filed in the present application are published in US Patent Publication Serial No. 2011/0073410 and are incorporated by reference herein.

FIELD OF THE INVENTION

The present invention relates to swimming pool equipment, in particular to a swimming pool ladder.

BACKGROUND AND SUMMARY OF THE INVENTION

In a prior design as shown in FIG. 1, a barrier 1' is positioned on a lower portion of a first ladder section. Existing barrier 1' extends from a top platform 2' of the ladder to a floor 3' of the swimming pool.

According to the present disclosure, a swimming pool ladder with a barrier is provided that comprises first and second ladder sections being positionable inside and outside a swimming pool. The first ladder section includes a plurality of steps including an uppermost step. The ladder further includes a top support platform connecting upper portions of the first and second ladder sections, and a triangular barrier having a first edge position adjacent the first ladder section and fixed to at least two steps with at least two connectors and a bottom edge positionable adjacent an inner sidewall of the swimming pool. A top end of the barrier is spaced apart from the top platform by a distance.

BRIEF DESCRIPTION OF THE DRAWINGS

The above-mentioned and other features and advantages of the invention, and the manner of attaining them, will become more apparent and the disclosure itself will be better understood by reference to the following description taken in conjunction with the accompanying drawings, wherein.

Figure 1:
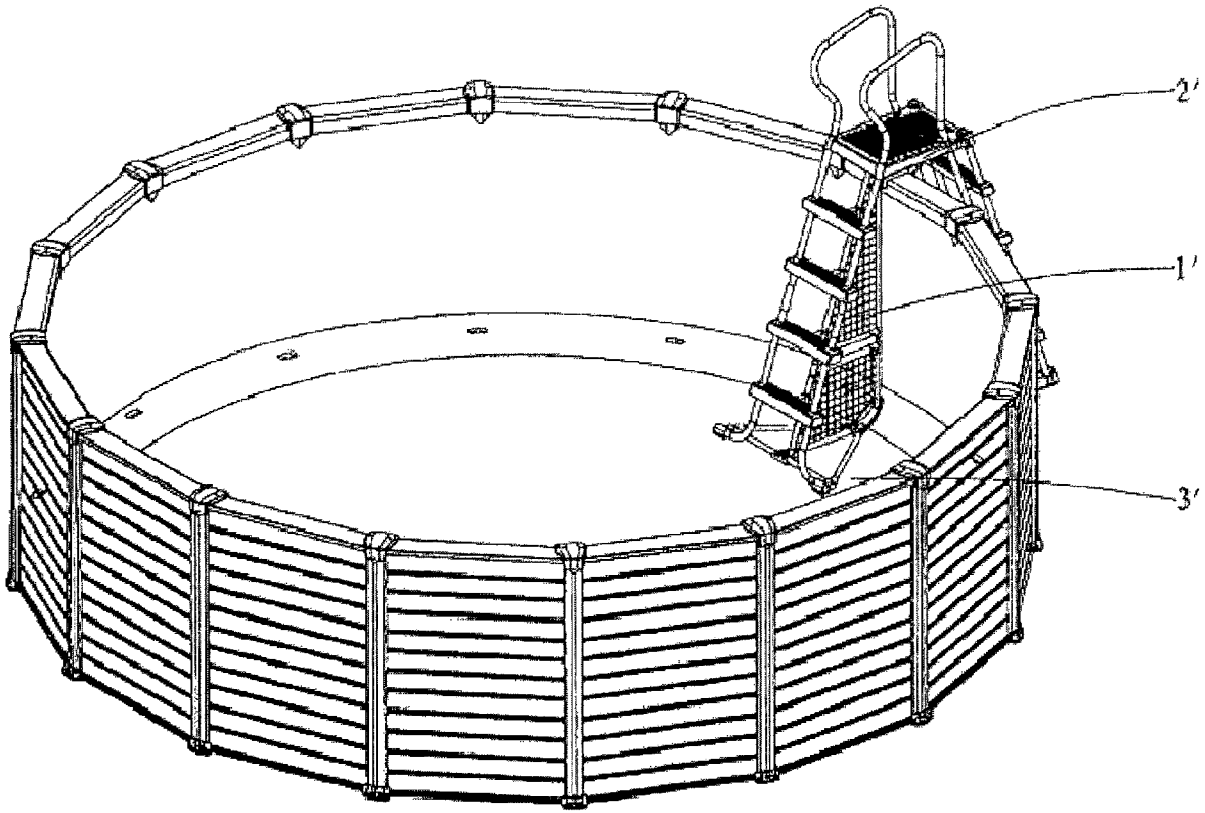
FIG. 1 (PRIOR ART)
FIG. 1 is a view showing prior swimming pool ladder with a barrier.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE PREFERRED EMBODIMENTS

The embodiments disclosed below are not intended to be exhaustive or limit the invention to the precise forms disclosed in the following detailed description. Rather, the embodiments are chosen and described so that others skilled in the art may utilize their teachings.

Figure 2:
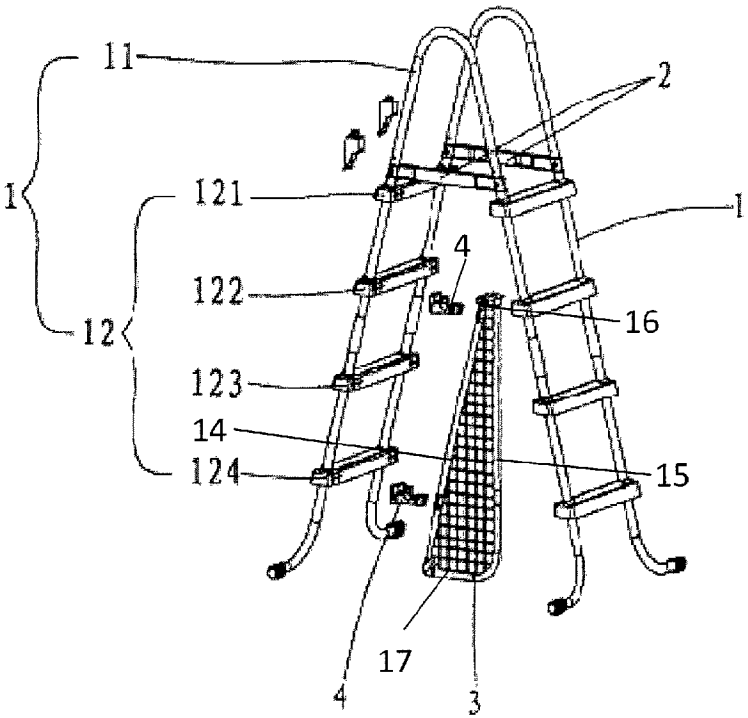
FIG. 2 an exploded view of a swimming pool ladder with a barrier according to the present disclosure.
Figure 4C:
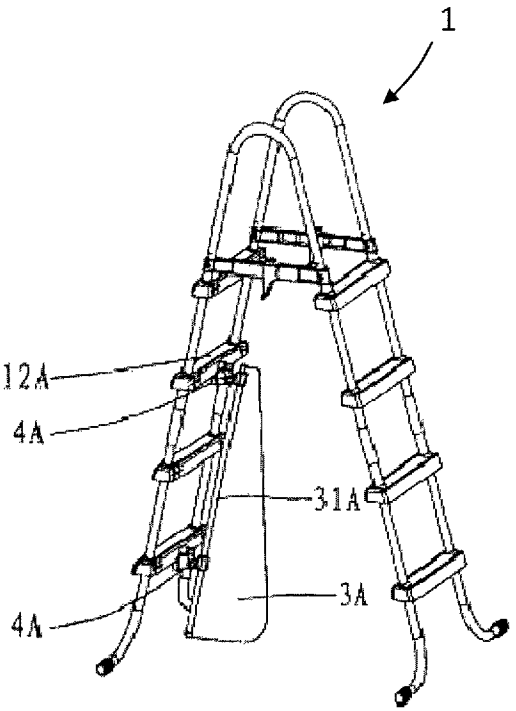
FIG. 4C is a view illustrating the mounting of the swing-type connector.
Figure 5:
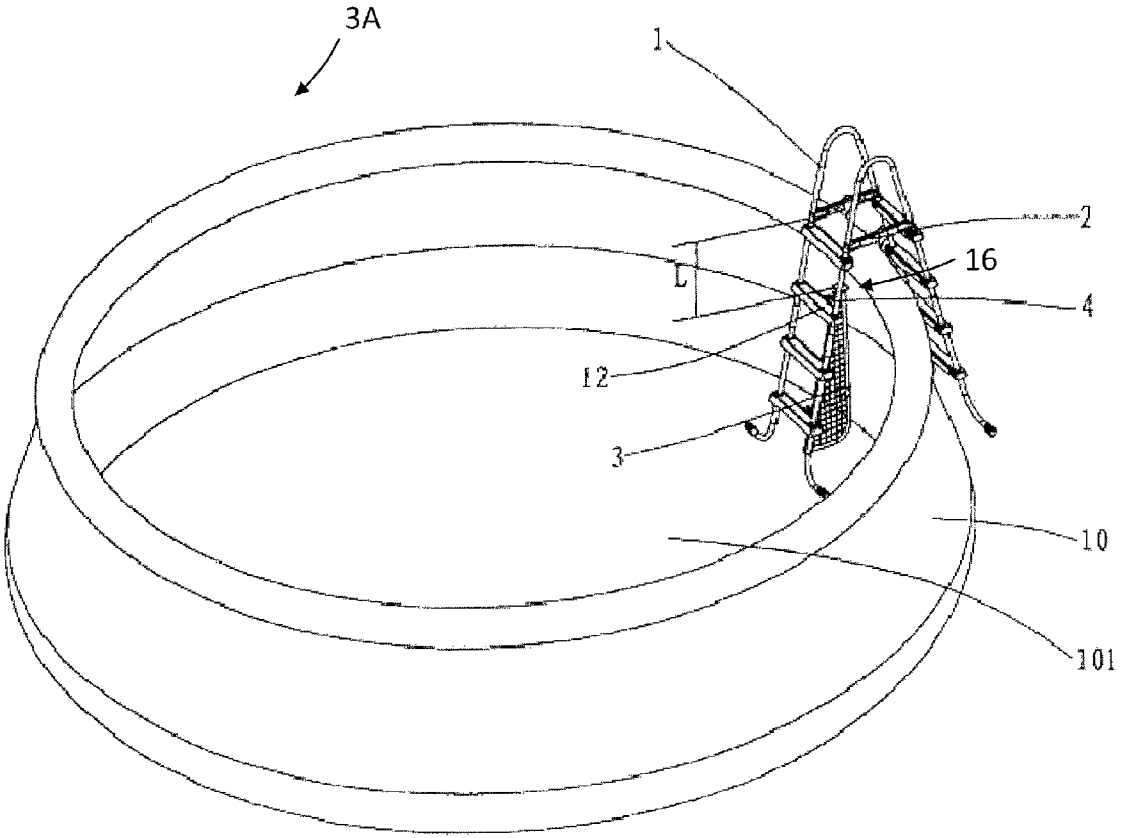
FIG. 5 is a view illustrating the application of the present ladder with barrier in an inflatable swimming pool.
Figure 6:
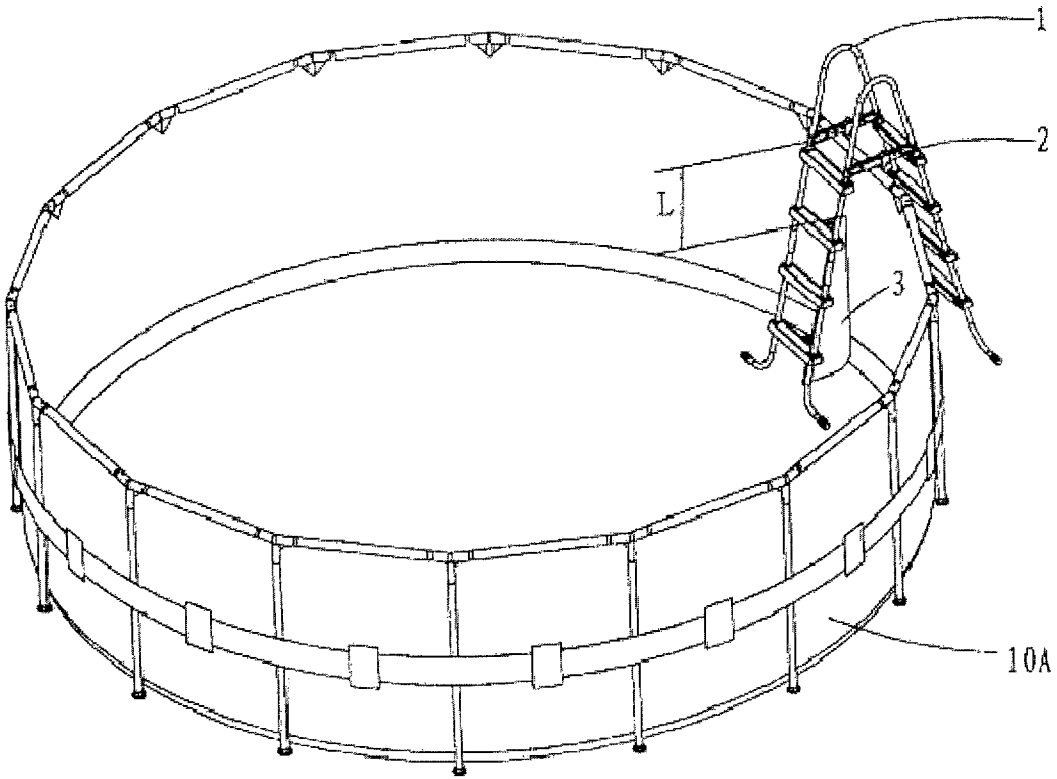
FIG. 6 is a view illustrating the application of the present ladder with barrier in a framed swimming pool.

As shown in FIG. 2, with reference also to FIG. 5, the present disclosure provides a swimming pool ladder 1 with a barrier 3. Ladder 1 includes two parallel rails 11 and four steps 12. When positioned in a pool 10, an inner or first section of ladder 1 is positioned within pool 10 and an outer or second section is positioned outside of pool 10. Ladder 1 further includes a top platform 2 (ladders without a platform are shown in FIGS. 2, 3B, 4C, 5, and 6') for supporting a person connected between the upper portions of rails 11 and positioned above the inflatable swimming pool 10 as shown in FIG. 5. As shown in FIG. 6, the manner in which barrier 3 is mounted to ladder 1 in a frame swimming pool 10A is the same as that in inflatable swimming pool 10.

Steps 12 are mounted at intervals between the two rails 11 from top to bottom. The step 12 closest to top platform 2 is an uppermost or first step 121. The other steps 12 are respectively a second step 122, a third step 123, and a bottommost or fourth step 124. Barrier 3 is perpendicular to an inner side face 13 of ladder 1 positioned in pool 10. Barrier 3 has a triangle shape, one edge 14 of which is adjacent inner side face 13 of ladder 1 and fixed on second step 122 and fourth step 124 through connecting pieces 4, and another edge 15 of which is adjacent the inner sidewall of swimming pool 10.

As shown in FIG. 5, a top end 16 of barrier 3 is spaced from top platform 2 by a certain distance L, which distance L is preferably larger than the interval of two steps 12. The bottom end of the barrier 3 is parallel to floor 101 of swimming pool 10, with a gap formed therebetween. The gap is sized as to not to allow a child to penetrate therethrough.

Figure 3A:
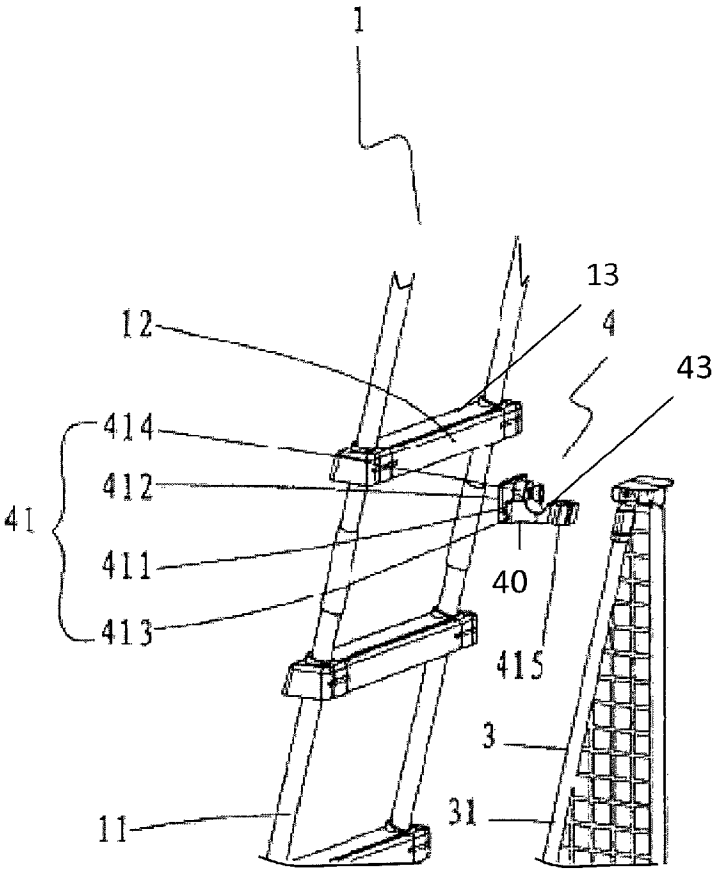
FIG. 3A is an enlarged view of a fixed-type connector piece of the present disclosure.

As shown in FIG. 3A, a connector piece 4 is preferably a fixed-type connector 4. Fixed-type connectors 4 include clamps 41 and locking screws 43. One side of each clamp 41 is provided with a slot body 410 having a rectangular through slot 411 that accommodates the wall thickness of steps 12 of ladder 1. An outer sidewall 412 of slot body 410 is higher than an inner sidewall 413. A nut seat 414 having a threaded bore is provided on the upper end face of inner sidewall 413. Locking screw 43 is threadedly connected to nut seat 414. The threadedly connected end portion of locking screw 43 abuts against sidewall 13 of step 12. A snap slot 415 that is snap-engaged with upright tube 31 of barrier 3 is provided at the other side of each clamp 41.

Figure 3B:
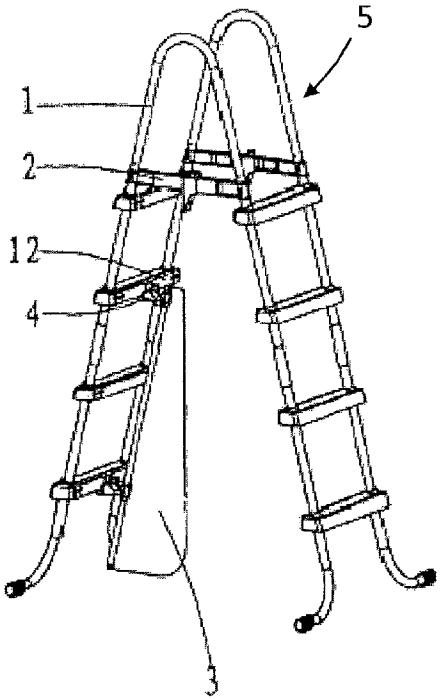
FIG. 3B is a view illustrating the mounting of the fixed-type connector of FIG. 3A.

Upon mounting, slot body 410 of clamp 41 is inserted onto sidewall 13 of step 12 (as shown in FIG. 3B). By rotating locking screws 43, a threadedly connected end portions of locking screws 43 abut against sidewall 13 of steps 12, and connector 4 is fixed on steps 12. Then, snap slot 415 of clamps 41 are snap-engaged with upright tube 31 of barrier 3, and mounting of barrier 3 is complete.

Figure 4A:
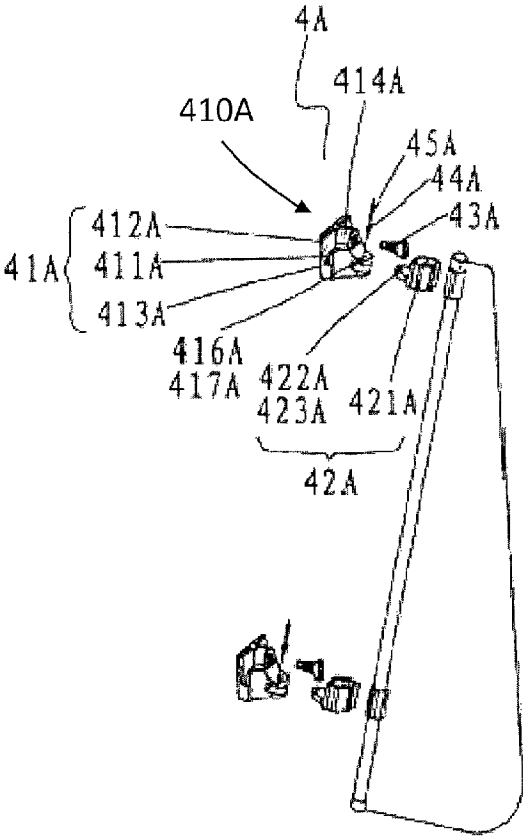
FIG. 4A an exploded view of a swing-type connector of the present disclosure.
Figure 4B:
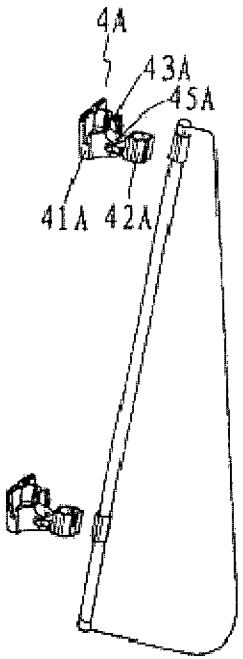
FIG. 4B is an assembled view of the swing-type connector.

As shown in FIG. 4A and FIG. 4B, connector 4A is a swing-type connector 4A. Connector 4A comprises a left clamp 41A, a right clamp 42A, a locking screw 43A, a torsion spring 44A, and a pin 45A.

Figure 4D:
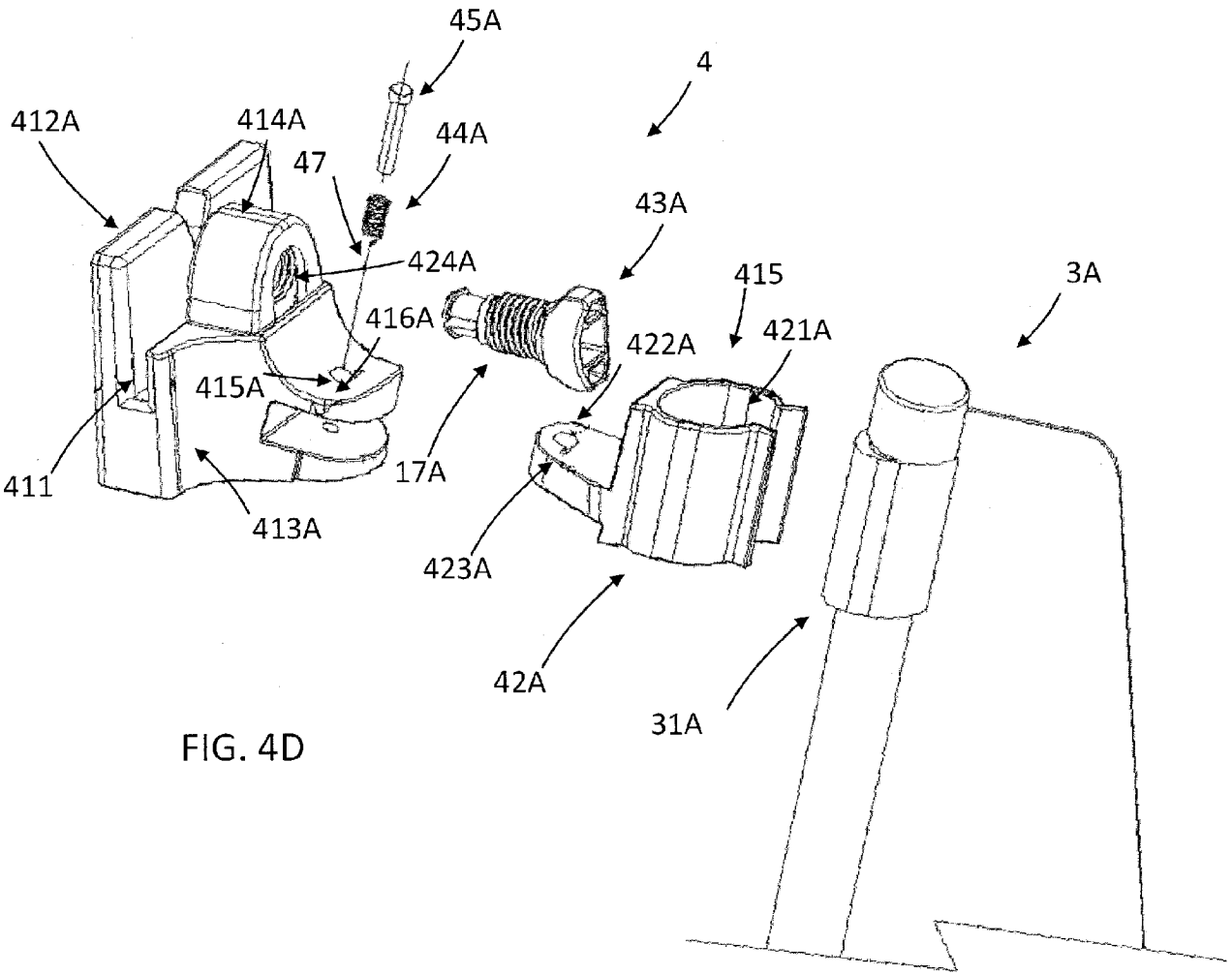
FIG. 4D is an enlarged exploded view of the swing-type connector.

Left clamp 41A is provided with a slot body 410A having a rectangular through slot 411A that matches the wall thickness of steps 12A of ladder 1 (as shown in FIG. 4C). An outer sidewall 412A of slot body 410A is higher than an inner sidewall 413A. A nut seat 414A having a threaded bore 424A is provided on the upper end face of inner sidewall 413A as shown in FIG. 4D. Locking screw 43A is threadedly connected to nut seat 414A. Threadedly connected end portion 17A of locking screw 43A abuts against outer sidewall 412A.

A snap slot 421A of right clamp 42A is snap-engaged with upright tube 31A of barrier 3A (as shown in FIG. 4C). Left clamp 41A and right clamp 42A are pivotably connected together through a pin 45A, and said right clamp 42A may swing in relation to said left clamp 41A. Apertures 416A, 423A for receiving legs 47 of spring 44A are provided adjacent pin hole 415A of left clamp 41A and pin hole 422A of right clamp 42A. Torsion spring 44A covers pin 45A and is inserted within pin hole 415A of left clamp 41A. Legs 47 at one end of torsion spring 44A are positioned in straight aperture 416A adjacent to pin hole 415A of left gripper 41A, and leg 47 at other end of torsion spring 44A is positioned in slot 423A adjacent to pin hole 422A of right clamp 42A. Thus, a torsional restoring force for aligning left clamp 41A and right clamp 42A is generated.

The above mentioned barrier may be a framework with a mesh-like material tightened thereon (see FIG. 2), or a panel structure made of relatively soft materials (see FIG. 3B), which not only may serve the function of a barrier, but also may be easily pushed through water.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A swimming pool ladder with a barrier including first and second ladder sections being positionable inside and outside a swimming pool, the first ladder section including a plurality of steps including an uppermost step, a top support platform connecting upper portions of the first and second ladder sections, and a triangular barrier having a first edge position adjacent the first ladder section and fixed to at least two steps with at least two connectors and a second edge positionable adjacent an inner sidewall of the swimming pool, a top end of the barrier is spaced apart from the top platform by a distance, wherein the triangular barrier includes a framework with at least one of the mesh material tightened thereon or a soft panel structure and at least one of the connector pieces includes a clamp having a slot body and a locking screw, the slot body includes a rectangular through slot that accommodates a thickness of a step.

2. The swimming pool ladder with barrier of claim 1, wherein the slot body includes an outer wall and an inner wall cooperating to define the rectangular through slot, the outer wall is higher than the inner wall.

3. The swimming pool ladder with barrier of claim 2, wherein an upper face of the inner side wall includes a nut seat having a threaded bore, the locking screw is threadedly connected to the nut seat, and an end portion of the locking screw abuts against at least one of the steps.

4. The swimming pool ladder with barrier of claim 1, wherein the clamp includes a snap slot that is snap-engaged with a upright tube of the barrier.

5. A swimming pool ladder with a barrier including first and second ladder sections being positionable inside and outside a swimming pool, the first ladder section including a plurality of steps including an uppermost step, a top support platform connecting upper portions of the first and second ladder sections, and a triangular barrier having a first edge position adjacent the first ladder section and fixed to at least two steps with at least two connectors and a second edge positionable adjacent an inner sidewall of the swimming pool, a top end of the barrier is spaced apart from the top platform by a distance, wherein the at least one of the connectors includes a first clamp, a second clamp, a locking screw, a torsion spring, and a pin coupling the first clamp to the second clamp.

6. The swimming pool ladder with a barrier of claim 5, wherein the first clamp includes a rectangular through slot that accommodates the wall thickness of the step.

7. The swimming pool ladder with a barrier of claim 6, wherein the first clamp includes an outer wall and an inner wall that cooperate to define the rectangular through slot, the outer wall is higher than the inner wall.

8. The swimming pool ladder with a barrier of claim 7, wherein an upper end face of the inner wall includes a nut seat having a threaded bore, the locking screw is threadedly connected to the nut seat, and an end portion of the locking screw abuts against at least one of the steps.

9. The swimming pool ladder with a barrier of claim 5, wherein the second clamp includes a snap slot engaged with an upright tube of the barrier.

10. The swimming pool ladder with a barrier of claim 5, wherein the torsion spring includes legs and the first and second clamps include straight slots for receiving the legs of the torsion spring; the pin is covered by the torsion spring.

* * * * *